US010954472B2

(12) United States Patent
Munoz Carrillo et al.

(10) Patent No.: US 10,954,472 B2
(45) Date of Patent: Mar. 23, 2021

(54) HARD SURFACE CLEANING COMPOSITIONS

(71) Applicant: Colgate-Palmolive Company, New York, NY (US)

(72) Inventors: Carlos Munoz Carrillo, Del Miguel Hidalgo (MX); Cesar Rodriguez Cedillo, Naucalpan de Juarez (MX); Edna Ambundo, Cranbury, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 15/772,747

(22) PCT Filed: Nov. 2, 2015

(86) PCT No.: PCT/US2015/058559
§ 371 (c)(1),
(2) Date: May 1, 2018

(87) PCT Pub. No.: WO2017/078663
PCT Pub. Date: May 11, 2017

(65) Prior Publication Data

US 2020/0010780 A1 Jan. 9, 2020

(51) Int. Cl.

| | |
|---|---|
| ***C11D 1/72*** | (2006.01) |
| ***C11D 1/722*** | (2006.01) |
| ***C11D 1/825*** | (2006.01) |
| ***B08B 3/04*** | (2006.01) |
| ***C11D 3/00*** | (2006.01) |
| ***C11D 3/30*** | (2006.01) |
| ***C11D 11/00*** | (2006.01) |
| ***C11D 17/00*** | (2006.01) |

(52) U.S. Cl.
CPC ..... *C11D 1/8255* (2013.01); *C11D 3/0026* (2013.01); *C11D 3/0047* (2013.01); *C11D 3/30* (2013.01); *C11D 11/0058* (2013.01); *C11D 17/0008* (2013.01); *C11D 1/72* (2013.01); *C11D 1/722* (2013.01)

(58) Field of Classification Search
CPC ..... C11D 1/72; C11D 1/722; C11D 1/825; B08B 3/04
See application file for complete search history.

(56) References Cited

U.S. PATENT DOCUMENTS

| | | | | |
|---|---|---|---|---|
| 3,650,965 A | | 3/1972 | Cantor et al. | |
| 4,349,448 A | * | 9/1982 | Steele | C23G 1/14 134/2 |
| 2008/0039357 A1 | * | 2/2008 | Gross | C11D 1/8255 510/471 |

FOREIGN PATENT DOCUMENTS

| | | |
|---|---|---|
| EP | 2692842 | 2/2014 |
| WO | 2005/085321 | 9/2005 |

OTHER PUBLICATIONS

International Search Report and Written Opinion of the International Searching Authority in International Application No. PCT/US2015/058559, dated Feb. 10, 2016.

* cited by examiner

*Primary Examiner* — Brian P Mruk

(57) ABSTRACT

Disclosed herein are hard surface cleaning compositions comprising, for example, a pH modifying agent in an amount sufficient to provide an alkaline pH; and a foaming system comprising: a nonionic ethoxylated/propoxylated surfactant; and a nonionic ethoxylated surfactant; wherein the concentration of the nonionic ethoxylated surfactant is greater than the concentration of the nonionic ethoxylated/propoxylated surfactant; and wherein the foaming system provides a structured network comprising a matrix having interstitial spaces. Methods of making and using these compositions are also described.

15 Claims, No Drawings

HARD SURFACE CLEANING COMPOSITIONS

BACKGROUND

Foam is an important visual signal for consumers in all-purpose cleaning products such as bucket-dilutable and spray cleaners. In general consumers perceive foam as a signal of product efficacy although the volume of foam preferred by consumers may vary by geographical region. For example, certain consumers may prefer a lower volume of foam in their cleaning products, because products that generate higher volumes of foam require more time and water to rinse and this is perceived as an inconvenience.

Defoaming agents are designed to prevent or control foam formation. The efficacy of these materials depends upon the bulk solution chemistry, surfactants creating the foam, process conditions where they are used to eliminate or control foam, and the end-use. Common defoaming agents include, hydrophobic liquids and/or solids, for example, non-polar oils such as silicone oils; polar oils such as fatty and ethoxylated or propoxylated alcohols; and hydrophobic solids such as treated silica and polypropylene.

Traditional foam control in cleaning formulations is approached by addition of these defoaming agents or low foam surfactants, which create a "permanent foam". These formulations, however, present two inconveniences for consumers: 1) formulations that do not generate foam, or generate low foam, are perceived as ineffective; and 2) permanent foam requires more time and water for removal.

As such, there remains a need for hard surface cleaners which provide foaming sufficient to confirm that they are effective, but which are easily removed after application to a surface. Embodiments of the present invention are designed to meet these needs.

SUMMARY

Some embodiments of the present invention provide a hard surface cleaning composition comprising: a pH modifying agent in an amount sufficient to provide an alkaline pH; and a foaming system comprising: from about 0.5% w/w to about 3% w/w of a nonionic ethoxylated/propoxylated surfactant; and from about 2% w/w to about 4% w/w of a nonionic ethoxylated surfactant; wherein the concentration of the nonionic ethoxylated surfactant is greater than the concentration of the nonionic ethoxylated/propoxylated surfactant; and wherein the foaming system provides a structured network comprising a matrix having interstitial spaces.

Other embodiments provide a method of cleaning a hard surface comprising: applying a hard surface cleaning composition according to any foregoing claim to a surface; waiting for from about 3 to about 5 minutes; and removing the composition from the surface.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION

The following description of the preferred embodiments is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Some embodiments of the present invention provide a hard surface cleaning composition comprising: a pH modifying agent in an amount sufficient to provide an alkaline pH; and a foaming system comprising: a nonionic ethoxylated/propoxylated surfactant; and a nonionic ethoxylated surfactant; wherein the concentration of the nonionic ethoxylated surfactant is greater than the concentration of the nonionic ethoxylated/propoxylated surfactant.

Other embodiments of the present invention provide a hard surface cleaning composition comprising: a pH modifying agent in an amount sufficient to provide an alkaline pH; and a foaming system comprising: from about 0.5% w/w to about 3% w/w of a nonionic ethoxylated/propoxylated surfactant; and from about 2% w/w to about 4% w/w of a nonionic ethoxylated surfactant; wherein the concentration of the nonionic ethoxylated surfactant is greater than the concentration of the nonionic ethoxylated/propoxylated surfactant. In some embodiments, the nonionic ethoxylated/propoxylated surfactant comprises less than 30% w/w of the total surfactant content in the composition.

In some embodiments, compositions of the present invention comprise from about 0.75% w/w to about 2% w/w of a nonionic ethoxylated/propoxylated surfactant; and from about 2.5% w/w to about 3% w/w of a nonionic ethoxylated surfactant. In other embodiments, compositions of the present invention comprise from about 0.8% w/w to about 1.5% w/w of a nonionic ethoxylated/propoxylated surfactant; and about 2.6% w/w of a nonionic ethoxylated surfactant. Still further embodiments provide compositions comprising about 1% w/w of a nonionic ethoxylated/propoxylated surfactant; and about 2.6% w/w of a nonionic ethoxylated surfactant.

In some embodiments, the pH modifying agent is selected from monoethanolamine, diethanolamine, triethanolamine, sodium hydroxide, and a combination of two or more thereof. In some embodiments, the pH modifying agent, e.g. monoethanolamine, provides a de-greasing benefit. In some embodiments, the monoethanolamine is present in an amount sufficient to assist in the removal of encrusted grease. In some embodiments, the encrusted grease refers to grease which is created by polymerization at high temperatures. In some embodiments, the pH modifying agent is present in the amount of from about 0.1% to about 1% w/w, of the composition. In some embodiments, the pH modifying agent is present in the amount of from about 0.25% to about 0.75% w/w, of the composition. In some embodiments, the pH modifying agent is present in the amount of about 0.5% w/w, of the composition. In some embodiments, the pH modifying agent is present in the amount of 0.51% w/w, of the composition.

In some embodiments, the composition is substantially foam free in less than about 5 minutes after agitation. In some embodiments, the composition is substantially foam free in less than about 5 minutes after application to a surface. In some embodiments, the composition is substantially foam free in from about 3 minutes to about 5 minutes after agitation. In some embodiments, the composition is substantially foam free in from about 3 minutes to about 5 minutes after application to a surface. In some embodiments, the composition is substantially foam free in about 4 minutes after agitation. In some embodiments, the composition is substantially foam free in about 4 minutes after application to a surface. In some embodiments, foaming is measured by a SITA Foam Tester. In some embodiments, including those described in this paragraph, foaming profiles are measured at room temperature.

As used herein, the term "easy rinse" refers to the ability of a composition to be at least substantially removed from a surface to which it is applied, after one wipe.

In some embodiments, the composition has a pH greater than about 7. In some embodiments, the composition has a pH greater than about 8. In some embodiments, the composition has a pH of from about 9 to about 13. In other embodiments, the composition has a pH of from about 10 to about 12. In other embodiments, the composition has a pH of 10.9 to 11.5.

In some embodiments, compositions of the present invention demonstrate stability after 13 weeks at 25° C., and 60% relative humidity (RH). In some embodiments, compositions of the present invention demonstrate stability after 13 weeks at 40° C., and at 75% RH. In some embodiments, the compositions of the present invention demonstrate physical stability under the aforementioned conditions. In some embodiments, the compositions of the present invention demonstrate chemical stability under the aforementioned conditions. In some embodiments, pH, solid content, precipitation, physical separation, color, odor and/or alkalinity are used to evaluate stability.

In some embodiments, the composition has less than 5 ethylene oxide groups. In some embodiments, the composition has greater than 11 ethylene oxide groups.

In some embodiments, the foaming system provides a structured network. In some embodiments, the structured network comprises a matrix having interstitial spaces. In some embodiments, the interstitial spaces are of a dimension sufficient to provide a matrix that collapses in less than about 5 minutes. In some embodiments, the interstitial spaces are of a dimension sufficient to provide a matrix that collapses in from about 3 minutes to about 5 minutes. In some embodiments, the interstitial spaces are of a dimension sufficient to provide a matrix that collapses in about 4 minutes.

In some embodiments, the foaming system is substantially free of silicone.

In some embodiments, the nonionic ethoxylated/propoxylated surfactant is sparingly soluble in aqueous solution.

In some embodiments, the composition has a cloud point of from about 35° C. to about 50° C. In other embodiments, the composition has a cloud point of from about 40° C. to about 45° C. Still further embodiments provide compositions having a cloud point of about 42° C.

Some embodiments provide a method of cleaning a hard surface comprising: applying a hard surface cleaning composition as described herein to a surface; waiting for from about 3 to about 5 minutes; and removing the composition from the surface.

The present inventors discovered the criticality of the ratio of a nonionic ethoxylated/propoxylated (EO/PO) surfactant alcohol and a nonionic ethoxylated surfactant in the foaming systems of the present invention. In particular, the present inventors discovered that high amounts of the nonionic EO/PO surfactant provide acceptable foam knockdown, but an unacceptable level of phase separation is observed. Similarly, if too much nonionic ethoxylated surfactant is present in the foaming system, the composition will avoid an unacceptable level of phase separation, but it will not be able to provide an easy rinse benefit.

In some embodiments, the ethoxylated alcohol comprises a $C_{11}$-$C_{12}$ alkyl chain. In some embodiments, the ethoxylated alcohol comprises from about 7.5 to about 8 moles of ethylene oxide.

In addition to discovering the critical ratio of nonionic EO/PO surfactant to ethoxylated surfactant, the present inventors also discovered that in order to incorporate the nonionic EO/PO surfactant at all, and provide the desired easy rinse benefit, the nonionic EO/PO surfactant must have the right balance of EO/PO. Specifically, higher ratios increase the hydrophobicity of the material and make it difficult to incorporate in the formula. In fact, blends of alcohols with higher PO ratios can result in a fast physical separation even under environmental conditions; and lower PO ratios—while reducing the hydrophobicity of the material and making them easier to incorporate and form a stable emulsion—can negatively impact the easy rinse benefit.

In some embodiments, compositions of the present invention provide an easy rinse benefit to the consumer. In some embodiments, the composition is alkaline. In further embodiments, the compositions generate a reduced quantity of foam during the cleaning process on the surface that is being cleaned, as well as on the cleaning implement e.g sponge. Other embodiments provide compositions which require a reduced amount of water to rinse/remove. Still further embodiments provide compositions which reduce the time required for rinsing. In some embodiments, the compositions provide excellent foam control at both ambient and elevated temperatures. In some embodiments, the compositions provide rapid foam knockdown. While in other embodiments, the cleaning benefits provided by the compositions of the present invention are comparable to commercially available degreasing compositions. In some embodiments, the compositions of the present invention are also cost effective, because less water is required to rinse the surface to which the cleaning compositions have been applied.

In some embodiments, the foaming system creates a structured network. In some embodiments, the structured network comprises a matrix having interstitial spaces. In some embodiments, the interstitial spaces must be of sufficient dimension to support the structured network. In some embodiments, the matrix must quickly assemble and quickly collapse. In some embodiments, it is the quick assembly and collapse of the matrix that conveys the cleaning perception to the user and provides the easy rinse benefit.

Stable foams generally require the inclusion of a surface-active agent, e.g. anionic surfactant. To create a foaming composition, sufficient surfactant must be adsorbed at the air-water interface to provide adequate surface tension gradients and repulsion forces across foam films; and sufficiently low surface tension to inhibit the effects of antifoam. Surface tension gradients are required for restoring forces opposing any external stress.

As used herein, "cloud point" refers to the temperature above which an aqueous solution of a water-soluble surfactant becomes turbid. Knowing the cloud point is important for determining storage stability, as storage of formulations at temperatures above the cloud point may result in phase separation and instability. Further, foaming characteristics may be different above and below the cloud point; and behavior above and below the cloud point may depend upon the particular surfactant used.

Cloud points are typically measured using aqueous surfactant solutions. Cloud points range from 0° to 100° C. (32 to 212° F.), limited by the freezing and boiling points of water. The presence of other components in a formulation can depress or increase the solution's cloud point. For example, the addition of a hydrotrope can increase the cloud point of a solution, whereas builders or other salts will depress the cloud point temperature.

In some embodiments, the composition comprises a glycol ether. In some embodiments, the composition comprises from about 0.1 to about 1.5%, by weight, of a glycol ether. In some embodiments, the glycol ether is selected from: propylene glycol n-butyl ether, propylene glycol n-propyl ether, ethylene glycol n-hexyl ether, ethylene glycol n-butyl ether, dipropylene glycol methyl ether, and combinations thereof. In some embodiments, the composition comprises from about 0.5% to about 1.5%, by weight, of propylene glycol n-butyl ether. In other embodiments, the composition comprises about 1%, by weight, of propylene glycol n-butyl ether.

In some embodiments, compositions of the present invention comprise an alcohol. In some embodiments, the alcohol comprises a $C_1$-$C_{12}$ alkyl alcohol. In some embodiments, the alcohol is selected from methanol, ethanol, n-propanol, isopropanol, n-butyl alcohol, sec-butyl alcohol, isobutyl alcohol, tort-butyl alcohol, 1- 2- or 3-pentanol, neopentyl alcohol, hexanol, and combinations of two or more thereof. In certain embodiments, the alcohol is present in the composition in an amount of about 0.1% to about 6% by weight, about 0.25% to about 5% by weight, about 0.5% to about 4.5% by weight. In some embodiments, the at least one alcohol comprises ethanol. In some embodiments, the ethanol is present in the amount of about 0.5%, by weight.

In some embodiments, the composition can optionally include a dispersant. In some embodiments, the dispersant can be present in any amount that provides a dispersant effect. In some embodiments, the dispersant is present in an amount of about 0.01 to about 1%, by weight.

In some embodiments, the composition comprises a fragrance or perfume. In some embodiments, the perfume is present in an amount of about 0.03 to about 0.8%, by weight, of the composition. The composition can additionally include any dye or coloring agent. Additionally the composition can contain a biocide/antibacterial agent, or any other material for a desired effect. Also, ammonium hydroxide and/or vinegar can be included, and in some embodiments they can be included up to about 0.2% by weight.

Some embodiments comprise water in an amount to make the sum of the amount of materials in the composition total 100 weight percent.

In some embodiments, the composition is substantially free of a propellant. Any foaming dispenser can be used to deliver the composition. In some embodiments, the dispenser is available from MeadWestvaco Calmar GmbH under the product name TS 800 Top Gun Trigger Sprayer. In some embodiments, the dispenser is coupled to mesh number 1 or mesh number 2.

The compositions of the present invention can be used as a cleaner on various surfaces, including—but not limited to—glass, stainless steel, ceramic, wood, tile, stone and the like. In some embodiments, the surface is a horizontal surface, which is parallel to the earth's surface. In some embodiments, the surface is a non-horizontal surface, such as those that are angled at greater than 0° to 90° to the earth's surface. In further embodiments, the composition can be used as a cleaner on a vertical surface, which is perpendicular to the earth's surface.

In some embodiments, the compositions can be used in a method for removing soil from a surface comprising applying the composition to the surface and removing the composition. In some embodiments, the step of removing the composition takes place within about 5 minutes of the composition being applied to the surface. In some embodiments, the step of removing includes, but is not limited to, wiping, squeegeeing, rinsing, and mopping.

Compositions of the present invention can be made according to methods generally known to those skilled in the art.

The invention is further described in the following examples. The examples are merely illustrative and do not in any way limit the scope of the invention as described and claimed.

EXAMPLES

Example 1

Table 1 (below) describes the formulations of an exemplary composition of the present invention (Ex. I) and two comparative compositions (Comp. Ex. I and Comp. Ex. II).

TABLE 1

| Ingredient | Ex. I | Comp. Ex. I | Comp. Ex. II | Comp. Ex. III |
|---|---|---|---|---|
| | % w/w | | | |
| Water | 93.12 | 90.14 | 91.14 | 90.45 |
| Ethoxylated nonionic surfactant | 2.60 | 0.45 | 0.45 | 2.58 |
| C9-11 Alcohol EO 2.5-8:1 | — | 0.55 | 0.55 | 0.41 |
| Ethoxylated/ Propoxylated nonionic surfactant | 1.00 | 1.00 | — | — |
| Sodium lauryl ether sulfate | — | 1.27 | 1.27 | — |
| Dipropylene Glycol Monobutyl Ether | 1.00 | 2.00 | 2.00 | 1.00 |
| Propylene Glycol N-butyl Ether | 1.00 | 1.00 | 1.00 | 1.00 |
| Ethyl Alcohol | 0.50 | 1.00 | 1.00 | 0.5 |
| Monoethanolamine | 0.51 | 1.50 | 1.50 | — |
| Cocoamidopropyl Betaine | — | 0.70 | 0.70 | — |
| Acrylic Polymers in Aqueous Soln. | — | 0.12 | 0.12 | — |
| Lactic acid | — | — | — | 3.09 |
| Fragrance | 0.27 | 0.27 | 0.27 | 0.47 |
| Silicone | — | — | — | 0.0025 |
| pH | 10.9-11.5 | 10.9-11.5 | 10.9-11.5 | 2-2.4 |

Example 2

Foaming characteristics of the exemplary composition and comparative compositions described above in Table 1 are evaluated in a SITA Foam Tester. The temperature of the products is controlled and foam is generated. A microcomputer controls the measurement of foam volume using a multi-probe sensor. Measurements are performed in triplicate for each formula tested and the results described in Table 2 below are averages from the three (3) replicate runs.

TABLE 2

| Composition | Foam Elimination (minutes) |
|---|---|
| Ex. I | 4 |
| Comp. Ex. I | 18 |
| Comp. Ex. II | 20 |
| Comp. Ex. III | 2 |

As shown above in Table 2, the exemplary composition of the present invention which includes the inventive foaming system comprising a nonionic ethoxylated/propoxylated surfactant alcohol and a nonionic ethoxylated surfactant, unexpectedly demonstrates foaming sufficient to create the perception that it is effective, but which is also easily removed from the surface to which it is applied.

Example 3

The stability and easy rinse benefit provided by an exemplary composition of the present invention (Ex. II) and two comparative compositions (Comp. Ex. IV and Comp. Ex. V) are evaluated. The formulations of Ex. II, Comp. Ex. IV and Comp. Ex. V are described below in Table 3; and the results of the aforementioned evaluation are described in Table 4 (below).

TABLE 3

| Ingredient | Ex. II | Comp. Ex. IV % w/w | Comp. Ex. V |
|---|---|---|---|
| Water | 93.12 | 91.14 | 93.72 |
| Ethoxylated nonionic surfactant | 2.60 | 0.45 | 1.00 |
| C9-11 Alcohol EO 2.5-8:1 | — | 0.55 | — |
| Ethoxylated/Propoxlated nonionic surfactant | 1.00 | — | 2.00 |
| Sodium lauryl ether sulfate | — | 1.27 | — |
| Dipropylene Glycol Monobutyl Ether | 1.00 | 2.00 | 1.00 |
| Propylene Glycol N-butyl Ether | 1.00 | 1.00 | 1.00 |
| Ethyl Alcohol | 0.50 | 1.00 | 0.5 |
| Monoethanolamine | 0.51 | 1.50 | 0.51 |
| Cocoamidopropyl Betaine | — | 0.70 | — |
| Acrylic Polymers in Aqueous Soln. | — | 0.12 | — |
| Fragrance | 0.27 | 0.27 | 0.27 |
| pH | 10.9-11.5 | 10.9-11.5 | 10.9-11.5 |

As illustrated by the data described in Table 4 (below), the exemplary composition of the present invention, which has the proper ratio of nonionic ethoxylated surfactant to nonionic ethoxylated/propoxylated surfactant, is able to provide a stable composition as well as the easy rinse benefit; whereas the two comparative compositions do not. Specifically, Comp. Ex. IV does not provide the easy rinse benefit, and Comp. Ex. V—which has the nonionic ethoxylated/propoxylated surfactant present at a concentration greater than the concentration of the nonionic ethoxylated surfactant—is not stable.

TABLE 4

| Temperature (° C.) | Ex. II | Comp. Ex. IV Flash Foam (mL) | Comp. Ex. V |
|---|---|---|---|
| 10 | 825 | 1089 | 475 |
| 25 | 799 | 1050 | 383 |
| 35 | 720 | 986 | 225 |
| 40 | 698 | 910 | 154 |
| 45 | 273 | 853 | 100 |
| 55 | 180 | 745 | 54 |
| Cloud Point | 42.5° C. | 55° C. | 35° C. |

While particular embodiments have been chosen to illustrate the invention, it will be understood by those skilled in the art that various changes and modifications can be made therein without departing from the scope of the invention as defined in the appended claims. Persons of ordinary skill in the art will readily appreciate that various combinations of the features depicted in the different views may be possible in some non-limiting embodiments of the present invention.

What is claimed is:

1. A hard surface cleaning composition comprising:

a pH modifying agent in an amount sufficient to provide an alkaline pH; and a foaming system comprising:

from about 0.5% w/w to about 3% w/w of a nonionic ethoxylated/propoxylated surfactant; and from about 2% w/w to about 4% w/w of a nonionic ethoxylated surfactant;

wherein the concentration of the nonionic ethoxylated surfactant is greater than the concentration of the nonionic ethoxylated/propoxylated surfactant;

wherein the concentration of the nonionic ethoxylated surfactant is not more than 2.6 times of the concentration of the nonionic ethoxylated/propoxylated surfactant; and wherein the foaming system provides a structured network comprising a matrix having interstitial spaces.

2. The hard surface cleaning composition according to claim 1, wherein the nonionic ethoxylated/propoxylated surfactant comprises less than 30% w/w of the total surfactant content in the composition.

3. The hard surface cleaning composition according to claim 1, wherein the composition is foam free in less than about 5 minutes at room temperature, after agitation.

4. The hard surface cleaning composition according to claim 1, wherein the composition is foam free in from about 3 minutes to about 5 minutes at room temperature after agitation.

5. The hard surface cleaning composition according to claim 1, wherein the composition is foam free after about 4 minutes at room temperature, after agitation.

6. The hard surface cleaning composition according to claim 1, wherein the composition has a pH greater than about 8.

7. The hard surface cleaning composition according to claim 1, wherein the composition has a pH of from about 9 to about 13.

8. The hard surface cleaning composition according to claim 1, wherein the composition has a pH of from about 10 to about 12.

9. The hard surface cleaning composition according to claim 1, wherein the composition demonstrates no phase separation.

10. The hard surface cleaning composition according to claim 1, wherein the nonionic ethoxylated/propoxylated surfactant does not have between 5 and 11 ethylene oxide groups.

11. The hard surface cleaning composition according to claim 1, wherein the interstitial spaces are of a dimension sufficient to provide a matrix that collapses in less than about 5 minutes.

12. The hard surface cleaning composition according to claim 1, wherein the foaming system is free of silicone.

13. The hard surface cleaning composition according to claim 1, wherein the nonionic ethoxylated/propoxylated surfactant is sparingly soluble in aqueous solution.

14. The hard surface cleaning composition according to claim 1, wherein the composition has a cloud point of from about 40° C. to about 45° C.

15. A method of cleaning a hard surface comprising:

applying a hard surface cleaning composition according to claim 1 to a surface;

waiting for from about 3 to about 5 minutes; and removing the composition from the surface.

* * * * *